US008931410B2

(12) United States Patent
Noy

(10) Patent No.: US 8,931,410 B2
(45) Date of Patent: Jan. 13, 2015

(54) SYSTEM AND METHOD FOR SETTING UP A PRINTING PRESS

(75) Inventor: Noam Noy, Natanya (IL)

(73) Assignee: Advanced Vision Technology (AVT) Ltd., Hod Hasharon (IL)

( * ) Notice: Subject to any disclaimer, the term of this patent is extended or adjusted under 35 U.S.C. 154(b) by 816 days.

(21) Appl. No.: 12/162,285

(22) PCT Filed: Jan. 23, 2007

(86) PCT No.: PCT/IL2007/000086

§ 371 (c)(1),
(2), (4) Date: Jan. 6, 2009

(87) PCT Pub. No.: WO2007/086052

PCT Pub. Date: Aug. 2, 2007

(65) Prior Publication Data

US 2009/0301330 A1 Dec. 10, 2009

Related U.S. Application Data

(60) Provisional application No. 60/762,377, filed on Jan. 25, 2006.

(51) Int. Cl.
*B41F 1/54* (2006.01)
*B41F 31/02* (2006.01)
(Continued)

(52) U.S. Cl.
CPC ..... *B41F 33/0036* (2013.01); *B41F 13/30* (2013.01); *B41P 2233/10* (2013.01)
USPC ..... 101/484; 101/211; 101/181; 101/348

(58) Field of Classification Search
USPC ..... 101/484–486, 137, 139, 140, 143–145, 101/184, 185, 192, 218, 247, 284, 285, 299, 101/306, 322, 323, 483
See application file for complete search history.

(56) References Cited

U.S. PATENT DOCUMENTS 5,448,949 A 9/1995 Bucher
5,805,280 A * 9/1998 Lasken et al. ..... 356/244
(Continued)

FOREIGN PATENT DOCUMENTS

DE 41 21 749 1/1993
EP 1 184 177 3/2002
(Continued)

*Primary Examiner* — David Banh
(74) *Attorney, Agent, or Firm* — Merchant & Gould P.C.

(57) ABSTRACT

A system for setting up a printing station (136), the printing station (136) includes printing rollers (110, 114, 116), the printing rollers (110, 114, 116) including at least one ink transferring roller (110, 114) and an impression roller (116). The system includes a camera (104), an actuator interface (106) and a processor (102), the actuator interface (106) being coupled with at least one actuator (108, 112), the processor (102) being coupled with the camera (104) and with the actuator interface (106), the actuator interface (106) directing the at least one actuator (108, 112) to move at least one printing roller (110, 114, 116) of the printing press (1OO). The processor (102) receives an output from the camera (104), the processor (102) determining at least one no print threshold respective of each adjacent pair of the printing rollers, according to the output respective of the absence or presence of the representative impression (132). In a setup pattern printing zone (134) of the print material (118), the at least one no print threshold is defined as the minimal distance between the rotation axes (122, 128, 130) of each adjacent pair of the printing rollers, at which no print liquid is transferred to the print material (118).

26 Claims, 5 Drawing Sheets

(51) Int. Cl.
*B41F 33/00* (2006.01)
*B41F 13/30* (2006.01)

(56) References Cited

U.S. PATENT DOCUMENTS

| | | | | |
|---|---|---|---|---|
| 5,841,955 | A | 11/1998 | Wang | |
| 6,166,366 | A | 12/2000 | Lewis et al. | |
| 6,634,297 | B2 | 10/2003 | Poetter et al. | |
| 2002/0134267 | A1* | 9/2002 | Kolbe et al. | 101/484 |
| 2003/0005840 | A1* | 1/2003 | Poetter et al. | 101/483 |
| 2005/0028700 | A1* | 2/2005 | Hauck | 101/483 |
| 2008/0196610 | A1* | 8/2008 | Roch et al. | 101/142 |
| 2008/0236430 | A1* | 10/2008 | Elter et al. | 101/484 |
| 2009/0126591 | A1* | 5/2009 | Puig Vila et al. | 101/486 |

FOREIGN PATENT DOCUMENTS

| | | |
|---|---|---|
| GB | 2 259 052 | 3/1993 |
| GB | 2 340 075 | 2/2000 |

* cited by examiner

SYSTEM AND METHOD FOR SETTING UP A PRINTING PRESS

FIELD OF THE DISCLOSED TECHNIQUE

The disclosed technique relates to printing presses in general, and to methods and systems for setting up a printing press, in particular.

BACKGROUND OF THE DISCLOSED TECHNIQUE

A color image is printed on a web substrate (e.g., paper) by employing various methods, such as a flexographic printing method and a rotogravure printing method. The flexographic printing method is performed by employing a plate cylinder, an anylox roller and an impression roller. The plate cylinder is located between the anylox roller and the impression roller. The plate cylinder is in contact with the anylox roller and with the impression roller. The web substrate is wound around the impression roller. The plate cylinder includes a pattern of an image which is to be printed on the web substrate. The anylox roller picks up ink from an ink basin, as the anylox roller rotates, and the anylox roller transfers the ink to the plate cylinder. The plate cylinder forms the image on the web substrate, according to the pattern thereof. For printing a color image on the web substrate, a printing press includes a flexographic printing station respective of each color of a color gamut, located in sequence, for example, one flexographic printing station for producing the image in red, one for green, and one for blue. The outer surface of each of the rollers is made of a resilient material, such as rubber, so that the pressure there between can be adjusted, by varying the distance between the rollers.

Prior to the print run, the printing press has to be set up (i.e., adjusted) in order to print the image on the web substrate, at an acceptable quality level. Methods for setting up the printing press are known in the art. In a manual method, the operator runs the printing press, inspects the printed image, and adjusts the pressure between the rollers, until the printed image is acceptable. In an automatic method, an opto-electronic sensor senses an image of a printed contact strip on the web substrate, and a controller adjusts the pressure between the rollers, according to the width of the contact strip, and according to the output of the opto-electronic sensor. In another automatic method, the controller adjusts the pressure between the rollers, by comparing the contour of the current image, with that of a desired image which is stored in a memory.

U.S. Pat. No. 6,634,297 B2 issued to Poetter et al., and entitled "Device and Process for Setting the Printed Image in a Flexographic Press", is directed to a system for setting up a printing job. The system includes a printing roller, an engraved roller, a counter-impression roller, an actuating device, a plurality of servo motors, a control and regulating unit, an input device and an input unit, and a camera. The control and regulating unit is connected to the input device, the input unit, the camera, and to the actuating device. The actuating device is connected to the servo motors. A first pair of servo motors is connected to each end of the engraved roller. A second pair of servo motors is connected to each end of the printing roller.

A paper web runs over the printing roller. The engraved roller is provided with an inking unit. The printing roller is provided with a plurality of blocks, to be printed on the paper web. The engraved roller picks up the ink from the inking unit, and transfers the ink to the printing roller by means of a contact there between. The printing roller transfers the ink to the paper web, by means of contact with the counter-impression roller, and in this manner, a pattern defined by the blocks of the printing roller, is printed on the paper web.

The first pair of servo motors provides horizontal movement of each end of the engraved roller. The second pair of servo motors provides horizontal movement of each end of the printing roller. The actuating device directs the servo motors to move each of the engraved roller and the printing roller, either individually or together, towards or away from the counter-impression roller. The desired contour which is to be printed on the paper web is entered into the control and regulating unit, by means of the input unit. The diameter of the printing roller and the thickness of the blocks are entered into the control and regulating unit, by means of the input device.

The camera scans the printed image and feeds the scanned image to the control and regulating unit. The control and regulating unit compares the scanned image with the desired contour, and directs the actuating device to control the servo motors, and to move the engraved roller and the printing roller to a position, which produces the qualitatively best printed image. The values respective of this position are stored in a storage of the control and regulating unit, so that the optimal setting can be found again.

U.S. Pat. No. 6,166,366 issued to Lewis et al., and entitled "System and Method for Monitoring and Controlling the Deposition of Patten and Overall Material Coatings", is directed to a system for detecting voids in a cold seal. The system includes a computer processor, a printing cylinder, an anylox roller, an ink tank, a traversing mechanism, an encoder, a display monitor and a touch screen. The traversing mechanism includes a camera and a radiation source. The encoder is connected to the anylox roller. The computer processor is connected to the encoder, the camera, the radiation source, the display monitor and to the touch screen.

The anylox roller picks up the ink from the ink tank and transfers the ink to a printing plate of the printing cylinder, in order to form the cold seal on a web substrate. The traversing mechanism moves the camera and the radiation source across the entire width of the web substrate. The encoder provides the signal to the computer processor in order to trigger the radiation source.

To set up the system, an operator positions the camera over the web substrate, at a position of interest where the camera can automatically view the coating on the web substrate, via the touch screen, while viewing an image of the web substrate on the display monitor. When the camera is positioned at the position of interest, the operator stores the position of interest in the computer processor, as the coating defect analysis position. The operator enters the maximum allowable coating void warning size, via the touch screen, and enables the automatic void detection. The computer processor determines whether there is a void larger than the maximum allowable coating void warning size, by employing a coating defect detection algorithm. In case the computer processor detects such a void, the computer processor produces a warning beacon, and directs the display monitor to display the void.

U.S. Pat. No. 5,448,949 issued to Bucher and entitled "Method and Device for Adjusting a Contact Pressure Between Ink-Carrying Cylinders of a Printing Machine", is directed to a system for setting up a printing job. The system includes a plate cylinder, a plurality of form rollers, a dampening roller, a connecting roller, a plurality of adjusting drives, a plurality of position sensors, an angular position sensor, two opto-electronic sensors and a control or regulating device. Each of the adjusting drives is connected to a respective one of the position sensors.

The form rollers and the dampening roller are connected with the respective adjusting drives. The angular position sensor is connected with a rotational axis of the plate cylinder. A flexible printing form is clamped to the plate cylinder. The position sensors, the angular position sensor, and the two opto-electronic sensors are connected to the control or regulating device.

The form rollers and the dampening roller are associated with the plate cylinder. The connecting roller is located between the form roller and the dampening roller. The two opto-electronic sensors are aimed at the surface of the flexible printing form, at the outer periphery of the plate cylinder, along a peripheral line. The adjusting drives provide engagement and disengagement of the form rollers and the dampening roller from the plate cylinder.

When the form rollers and the dampening roller are engaged with the plate cylinder, and when the plate cylinder is stationary, the form rollers and the dampening roller are inked, and a contact strip is formed on the surface of the printing form. When the plate cylinder rotates, the two opto-electronic sensors sense the contact strip. The control or regulating device determines the association between an output of the two opto-electronic sensors, and the form rollers and the dampening roller. The control or regulating device determines the width of the contact strip, according to outputs of the angular position sensor and the two opto-electronic sensors. The control or regulating device directs the adjusting drives to move the form roller and the dampening roller, according to the width of the contact strip, in order to adjust the contact pressure between each one of the form rollers and the dampening roller on one hand, and the plate cylinder on the other.

U.S. Pat. No. 5,841,955 issued to Wang and entitled "Control System For a Printing Press", is directed to a system for adjusting various parameters of a printing press, in real-time, by comparing the variation of ink distribution for each of the cyan, magenta, yellow and black colors, in a current copy, with those in a reference copy. The system includes a digital computer, a first video camera, a second video camera, a pair of lights, and a support. The first video camera and the second video camera are connected with the digital computer. The first video camera detects attributes of ink from a sheet of paper, in the visible region of the electromagnetic spectrum. The second video camera detects attributes of the ink from the sheet of paper, in the infrared region of the electromagnetic spectrum.

The pair of lights is located above the support. The first video camera and the second video camera are located above the support, such that each of the first video camera and the second video camera can capture an image on the sheet of paper, which is placed on the support. The reference copy is placed on the support and each of the first video camera and the second video camera, captures a reference image respective of the reference copy. The digital computer stores the information respective of the reference image in a memory thereof. The current copy is placed on the support and each of the first video camera and the second video camera captures a current image respective of the current copy. The digital computer stores the information respective of the current image in the memory.

The digital computer converts the red, green, blue and infrared images captured by the first video camera and the second video camera, into four separated cyan, magenta, yellow, and black images, which represent the amount of ink present on the current copy, by employing an ink separation process. The digital computer performs the same ink separation process with respect to the reference copy. The digital computer detects the variation of ink distribution for each of the cyan, magenta, yellow and black inks, by comparing the current image with the reference image. The digital computer adjusts various ink parameters, such as ink feed rate and ink water balance, by analyzing the characteristic of the ink distribution variation.

UK Patent Application GB 2340075 A to Peer Dilling and entitled "Image-Data-Oriented Printing Machine and Method" is directed to a method for adjusting the printing parameters of a printing machine dynamically during the production run, and statistically prior to the production run. The printing machine includes an ink applicator roll, a plate cylinder, a transfer cylinder, an impression cylinder, a printing material, a plurality of actuators, a plurality of sensors, a doctor, and a computer.

The actuators and the sensors are connected to the computer. The doctor rests on the ink applicator roll. The ink applicator roll is in contact with the plate cylinder. The plate cylinder is in contact with the transfer cylinder. The transfer cylinder is in contact between the impression cylinder and the plate cylinder. The printing material passes between the transfer cylinder and the impression cylinder.

The computer includes an expert system. The ink applicator roll inks the plate cylinder which provides the printing material with an image, via the transfer cylinder. The sensors are of different types, such as rotational speed sensor, temperature sensor, layer thickness sensor, optical density sensor, and surface roughness sensor. The computer directs each actuator to vary the distance between the respective roller, according to a feedback from the respective sensor, and according to a quality strategy, such as homogeneity of the image, the contrast, the hue, the saturation, and the lightness of the image.

SUMMARY OF THE PRESENT DISCLOSED TECHNIQUE

It is an object of the disclosed technique to provide a novel method and system for setting up a printing press. In accordance with the disclosed technique, there is thus provided a system for setting up a printing station. The printing station includes a plurality of printing rollers. The printing rollers include at least one ink transferring roller and an impression roller. The system comprises a camera, an actuator interface and a processor. The actuator interface is coupled with at least one actuator. The processor is coupled with the camera and with the actuator interface. The actuator interface directs the at least one actuator to move the at least one printing roller of said the printing press. The processor receives an output from the camera. The processor further determines at least one no-print threshold respective of the each adjacent pair of the printing rollers. The processor determines this no-print threshold according to the output respective of the absence or presence of the representative impression, in a setup pattern printing zone of the print material. The at least one no-print threshold is defined as the minimal distance between the rotation axes of the each adjacent pair of the printing rollers, at which no print liquid is transferred to the print material.

In accordance with another aspect of the disclosed technique, there is thus provided a system for setting up a printing press. The printing press includes at least one printing station. The at least one printing station includes a plurality of printing rollers. The printing rollers includes at least one ink transferring roller and an impression roller. The system comprises a camera, an actuator interface and a processor. The actuator interface is coupled with at least one actuator. The processor is coupled with the camera and with the actuator interface. The actuator interface directs the at least one actuator to move the at least one printing roller of said the printing press. The processor receives an output from the camera. The processor further determines at least one no-print threshold respective of the each adjacent pair of the printing rollers. The processor determines this no-print threshold according to the output respective of the absence or presence of the representative impression, in a setup pattern printing zone of the print material. The at least one no-print threshold is defined as the minimal distance between the rotation axes of the each adjacent pair of the printing rollers, at which no print liquid is transferred to the print material.

In accordance with a further aspect of the disclosed technique there is thus provided a method for setting up a printing press. The printing press includes at least one printing station. The method comprising the procedures of attempting to print a setup pattern in a setup pattern printing zone of a print material of said printing press and determining a no-print threshold for at least one pair of adjacent printing rollers for each of said at least one printing station. The setup pattern printing zone includes at least one representative impression. Each of said at least one representative impression is associated with a respective one of said at least one printing station. The no-print threshold is determined by varying the distance between the rotation axes of said at least one pair of adjacent printing rollers, and by detecting the presence or absence of print liquid in said setup pattern printing zone. The presence or absence of print liquid is determined at different values of said distance. The no-print threshold is defined as the minimal distance between said rotation axes, at which no print liquid is transferred to said print material.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by moving the rollers apart until no ink is transferred to the rollers and in turn to the print material, and moving the rollers back towards one another, from this no-print point, according to the printing parameters, to set up the printing press. For this purpose, each printing station prints a representative impression, respective of that printing station, on a substrate, thereby forming a setup pattern. The setup pattern is located in a setup pattern printing zone of the substrate. An image detector detects all the representative impressions in this setup pattern, all at once. A processor determines the amount by which every pair of adjacent rollers of each printing station have to be moved relative to one another, until the image detector indicates that no print liquid is transferred to the print material.

Each printing station includes a plurality of printing rollers. The term "ink transferring roller" herein below, refers to a roller of a printing station of a printing press, which includes at least one such roller, and an impression roller. The ink transferring roller transfers ink to another adjacent roller of the printing station. Hence, a first ink transferring roller (i.e., anylox roller) transfers ink from an ink tank to a second adjacent roller, and the last ink transferring roller transfers the ink from the previously adjacent roller, to the impression roller, on which a substrate is located, thereby printing an image on the substrate. The term "print liquid" herein below, refers to a liquid which each printing station applies to the substrate. The print liquid can be an ink, an adhesive, a lacquer, and the like. Hence, the term "print liquid transferring roller" herein below, refers to a roller among the printing rollers, which transfers the print liquid from one roller to an adjacent roller.

Figure 1:
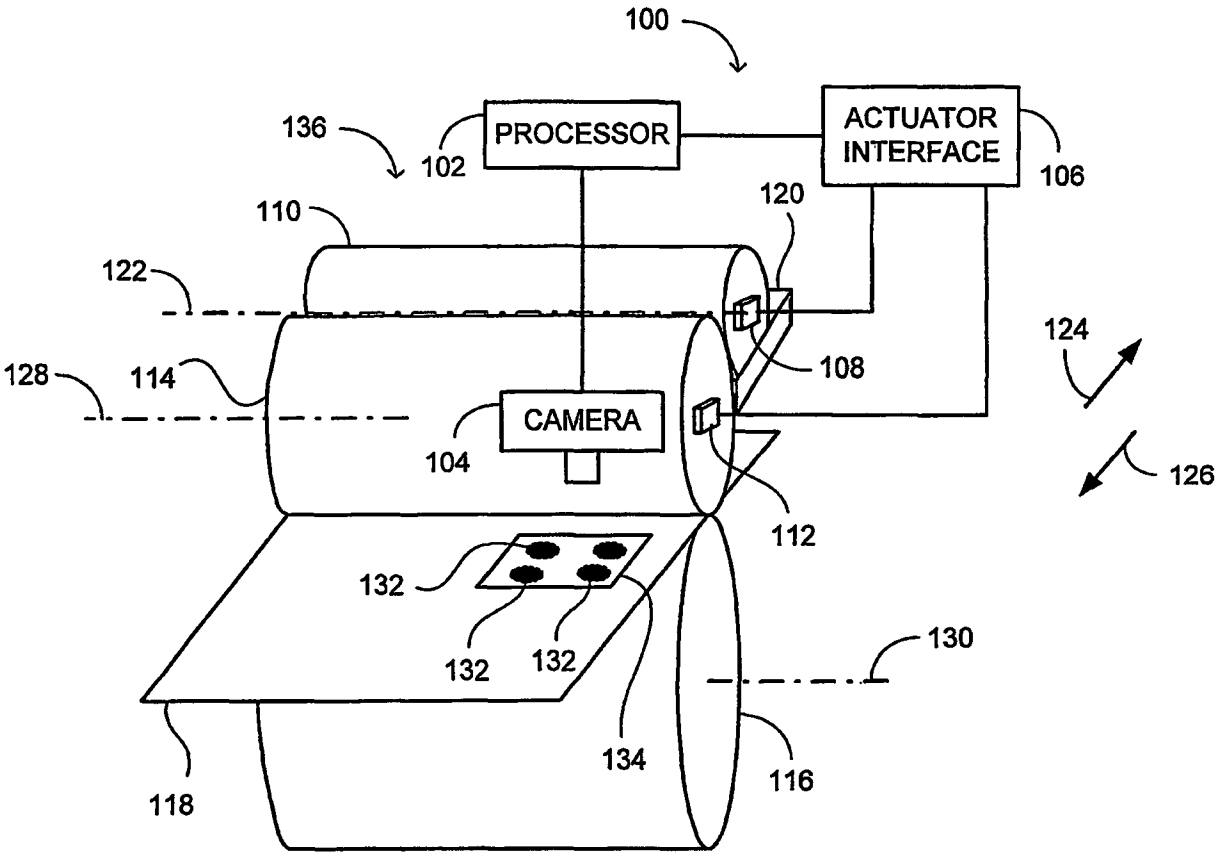
FIG. 1 is a schematic illustration of a system for setting up a printing press constructed and operative in accordance with an embodiment of the disclosed technique.
Figure 2:
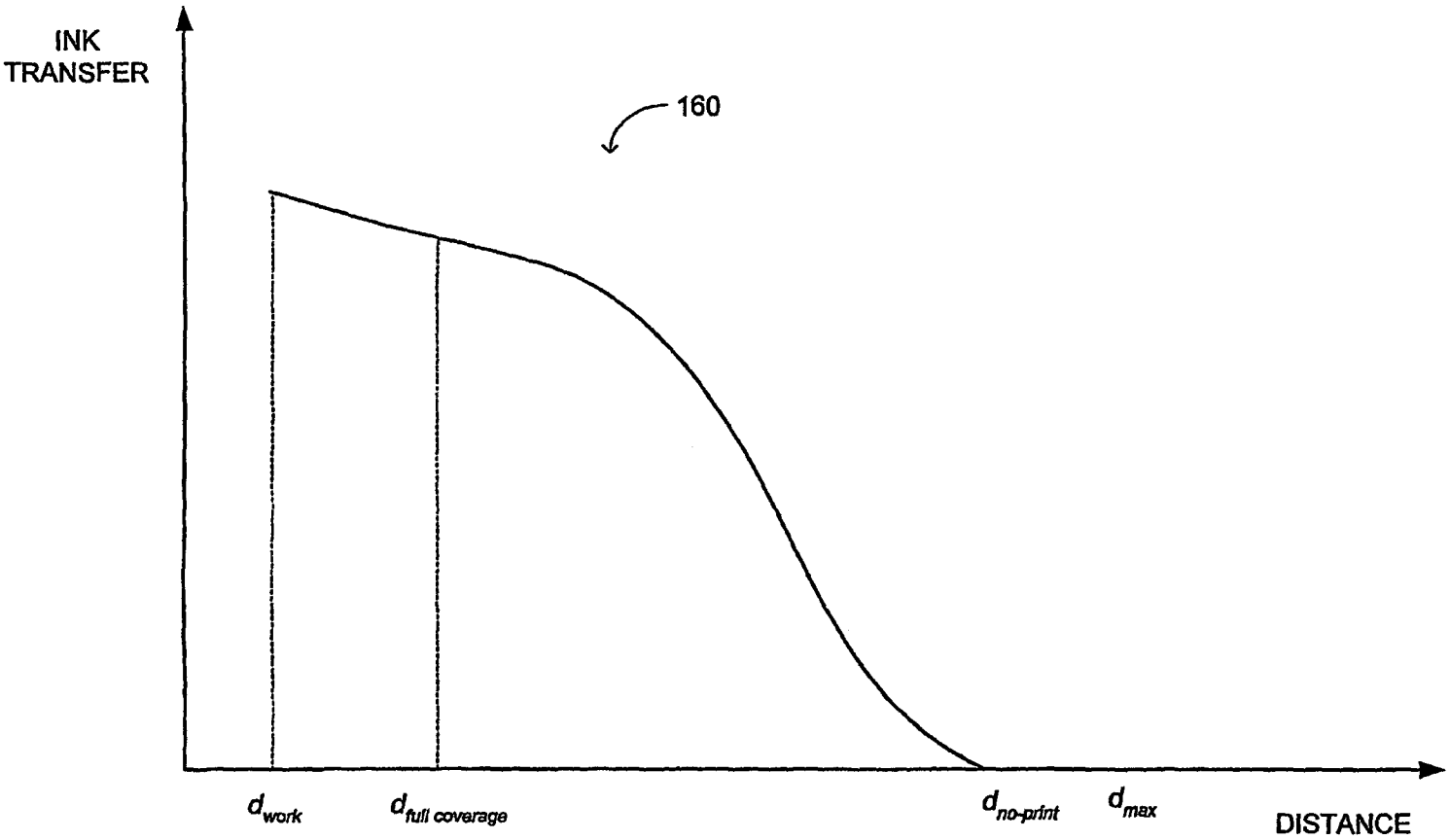
FIG. 2 is a schematic illustration of a characteristic curve respective of the printing press of FIG. 1, defining the amount of ink transferred to a substrate, as a function of the distance between rotation axes of a pair of adjacent rollers of the printing press.

Reference is now made to FIGS. 1 and 2. FIG. 1 is a schematic illustration of a system for setting up a printing press, generally referenced 100, constructed and operative in accordance with an embodiment of the disclosed technique. FIG. 2 is a schematic illustration of a characteristic curve generally referenced 160, respective of the printing press of FIG. 1, defining the amount of ink transferred to a substrate, as a function of the distance between rotation axes of a pair of adjacent rollers of the printing press.

With reference to FIG. 1, system 100 includes a processor 102, a camera 104 and an actuator interface 106. Processor 102 is coupled with camera 104 and with actuator interface 106. Camera 104 is a device which can detect the presence and absence of an impression which is printed on a substrate (e.g., paper web), by a printing press on a substrate. Camera 104 can detect the presence of impressions having different characteristics (e.g., color, shape, relative location within the setup pattern). Accordingly, camera 104 can be a black and white gray level camera or a color camera. Camera 104 can be in the form of a linear charge-coupled device (CCD), CCD array, and the like. The CCD can be made of a semiconductor, such as silicon, complementary metal-oxide semiconductor (CMOS), and the like. Alternatively, camera 104 can be replaced by a spectrophotometer. Camera 104 can operate for example, according to the red-green-blue (RGB) color gamut, cyan-magenta-yellow (CMY) color gamut, and the like. System 100 can include one or more cameras (not shown) in addition to camera 104.

Actuator interface 106 is coupled with a first set of actuators 108 of a first roller 110, and with a second set of actuators 112 of a second roller 114. Actuator interface 106 can be in the form of a digital to analog converter (ADC), which converts a digital output of processor 102 to an analog output, in order to actuate each of the first set of actuators 108 and the second set of actuators 112. Each of actuators 108 and 112 can be a rotary electric motor, a linear electric motor, piezoelectric actuator, hydraulic actuator, pneumatic actuator, bimetallic actuator, and the like. Each of actuators 108 and 112 can include a power transmission (not shown), such as gears, pulleys, timing belts, and the like. First roller 110 (i.e., anylox roller) is in rolling contact with second roller 114 (i.e., plate cylinder). Second roller 114 is in rolling contact with an impression roller 116. A substrate 118 (i.e., print material) is located between second roller 114 and impression roller 116. Substrate 118 can be in the form of a web (e.g., paper) which unwinds from impression roller 116 to be rolled around a take-up cylinder (not shown).

Second roller 114 includes an image impression (e.g., a series of protrusions, a series of depressions) of an image (not shown) which is to be printed on substrate 118. First roller 110 picks up ink (i.e., print liquid) from an ink tank 120, and transfers the ink to second roller 114, as first roller 110 and second roller 114 rotate relative to one another. Second roller 114 transfers the ink to substrate 118, thereby printing the image on substrate 118. The first set of actuators 108, the second set of actuators 112, first roller 110, second roller 114, impression roller 116, substrate 118 and ink tank 120, together form a printing station 136.

Each of first roller 110 and impression roller 116 is made of a rigid material, such as metal, ceramic, and the like. An outer surface of second roller 114 is made of an elastic material, such as photopolymer, an elastomeric polymer (e.g., natural rubber, synthetic rubber), and the like. A rotation axis 122 of first roller 110 can move in directions designated by arrows 124 and 126. A rotation axis 128 of second roller 114 can move in directions 124 and 126. Each of rotation axes 122 and 128 can move in directions 124 and 126, while one end thereof remains substantially stationary. Alternatively, each of rotation axes 122 and 128 can move in directions 124 and 126, while both ends thereof move simultaneously by substantially the same amount. A rotation axis 130 of impression roller 116 is substantially stationary.

The first set of actuators 108 and the second set of actuators 112 move rotation axes 122 and 128, respectively, in directions 124 and 126, thereby varying the distance between rotation axes 122 and 128, and varying the contact pressure between first roller 110 and second roller 114. Movement of rotation axis 128 relative to rotation axis 130, causes the contact pressure between second roller 114 and impression roller 116 to change.

Camera 104 is located above substrate 118. When the contact pressure between first roller 110 and second roller 114, and between second roller 114 and impression roller 116 is minimal, second roller 114 prints one or more representative impressions 132 respective of the color of the ink in ink tank 120, in a setup pattern printing zone 134 of substrate 118. Setup pattern printing zone 134 is located at a predetermined location on substrate 118, for example at a margin thereof. Camera 104 detects the presence of representative impressions 132, in setup pattern printing zone 134, and processor 102 determines that representative impressions 132 are present at this setting of actuators 108 and 112, according to an output of camera 104.

With reference to FIG. 2, when the distance between rotation axes 122 and 128 is equal to $d_{full\ coverage}$, second roller 114 and impression roller 116 transfer the ink to substrate 118, and camera 104 detects the presence of representative impressions 132 in setup pattern printing zone 134. Processor 102 directs actuators 108 to move rotation axis 122 in direction 124 (i.e., away from rotation axis 128). At this point the distance between rotation axes 122 and 128 is $d_{no\text{-}print}$, where no ink is transferred to substrate 118. At this point, the contact pressure between first roller 110 and second roller 114 is minimal (e.g., zero). Processor 102 associates the distance $d_{no\text{-}print}$ between rotation axes 122 and 128 (i.e., a minimal distance), with a no-print threshold $T_1$ respective of the pair of first roller 110 and second roller 114.

It is noted that processor 102 can search for the no-print threshold $T_1$ in a recursive manner, by directing actuators 108 to move rotation axes 122 and 128 back and forth away and towards one another to distances greater than, less than, or equal to $d_{no\text{-}print}$ respectively, until processor 102 determines that representative impressions 132 are absent from setup pattern printing zone 134. It is further noted that processor 102 can determine no-print threshold $T_1$ by directing actuators 108 to initially set the distance between rotation axes 122 and 128, at a distance greater than $d_{no\text{-}print}$, for example at $d_{max}$, where representative impressions 132 are not printed. Alternatively, processor 102 can determine no-print threshold $T_1$ by directing actuators 108 to initially set the distance between rotation axes 122 and 128, at any distance less than $d_{no\text{-}print}$.

Processor 102 can search for the no-print threshold, $d_{no\text{-}print}$, according to methods known in the art. Searching for $d_{no\text{-}print}$ is similar to searching a value in a sorted list. Such methods are, for example, a binary search, linear search, and the like. In these types of searches, the distance between the rollers is equivalent to the index (i.e., the numbered place of a value) of the values in the list. The binary search begins by dividing the sorted list into two parts, at the median index. When processor 102 detects a representative impression, respective of a printing station, printed on the print material, then, processor 102 disregards the part of the list with indices (i.e., distances) smaller than the median distance. When processor 102 does not detect a representative impression, respective of a printing station, printed on the print material, then, processor 102 disregards the part of the list with indices (i.e., distance) larger than the median distance. Processor 102 repeats the above process with the half list that was not disregarded, and treats this half list as a new sorted list.

Processor 102 directs actuators 108 to move rotation axis 122 back toward rotation axis 128 to ensure that representative impressions 132 are printed on substrate 118. At this point, the distance between rotation axes 128 and 130 is minimal, second roller 114 and impression roller 116 transfer the ink from ink tank 120 to substrate 118, and camera 104 detects the presence of representative impressions 132 which second roller 114 prints in setup pattern printing zone 134 of substrate 118. Processor 102 determines a no-print threshold $T_2$ respective of the pair of second roller 114 and impression roller 116, similar to the way processor determines the no-print threshold $T_1$ respective of the pair of first roller 110 and second roller 114, as described herein above.

In order to setup printing station 136, a user (not shown) enters one or more printing parameters to processor 102, via a user interface (not shown), coupled with the processor. Processor 102 directs actuators 108 and 112 to move rotation axes 122 and 128, respectively (i.e., set the distances between rotation axes 122 and 128), according to the printing parameters, relative to the no-print thresholds $T_1$ and $T_2$, respectively. Processor 102 directs actuators 108 and 112 to set the distances between rotation axes 122 and 128, at a working distance $d_{work}$ (i.e., the distance between rotation axes 122 and 128 at which printing station 136 prints the respective printing job thereof), determined from the entered printing parameters. The printing parameters can be the material of the outer surface of each of first roller 110, of second roller 114, and of impression roller 116, the thickness of the material of the outer surface of second roller 114, the roughness and hardness of the material of the outer surface of first roller 110, physical properties of the ink in an ink tank 120 (e.g., viscosity, temperature, color), the type of substrate 118 (e.g., paper weight), speed of travel of substrate 118, and the like.

Processor 102 can direct actuators 108 and 112 to set the distances between rotation axes 122 and 128, according to the printing parameters, for example, by employing a look-up table, an algorithm, and the like. Printing station 136 is a flexographic printing station. However, it is noted that the disclosed technique applies to other types of printing presses, such as gravure, offset, and the like.

Figure 3:
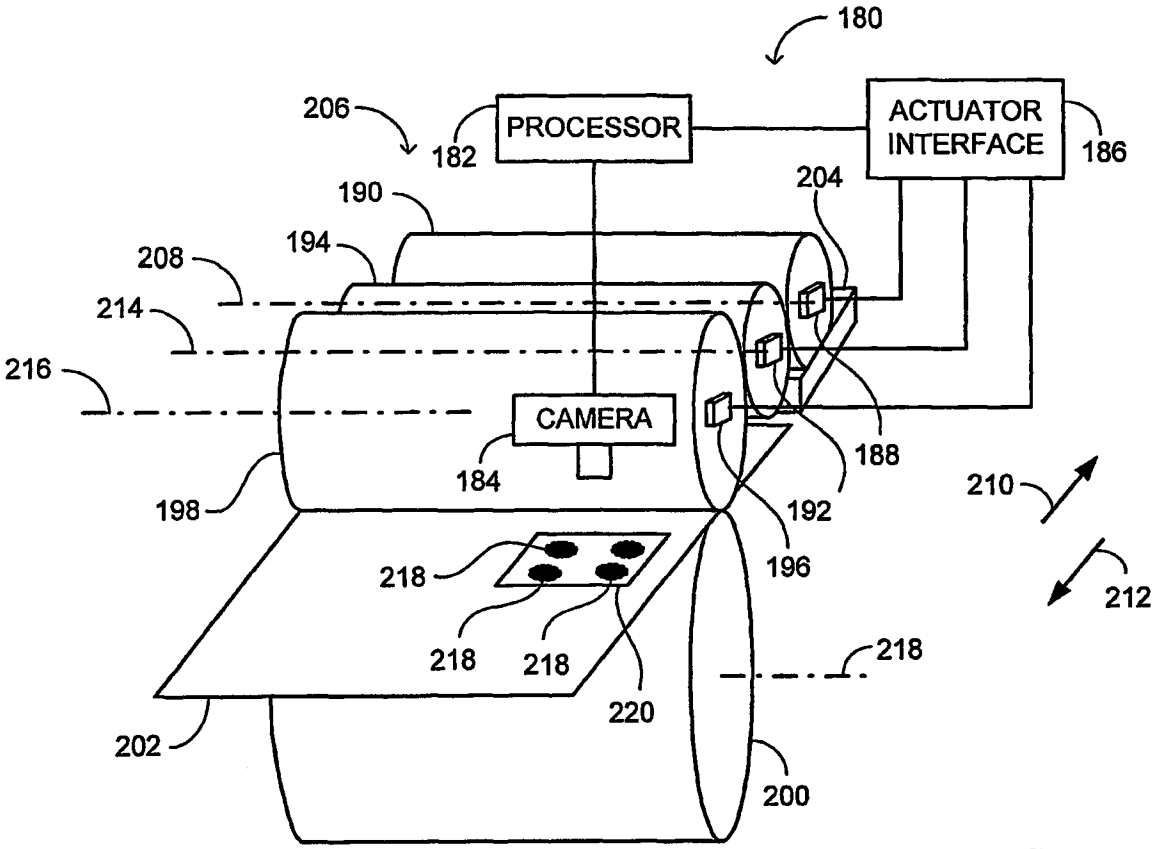
FIG. 3, is a schematic illustration of a system for setting up a printing press, constructed and operative in accordance with another embodiment of the disclosed technique.

Reference is now made to FIG. 3, which is a schematic illustration of a system for setting up a printing press, generally referenced 180, constructed and operative in accordance with another embodiment of the disclosed technique. System 180 includes a processor 182, a camera 184 and an actuator interface 186. Processor 182 is coupled with camera 184 and with actuator interface 186. Actuator interface 186 is coupled with a first set of actuators 188 of a first roller 190, a second set of actuators 192 of a second roller 194, and with a third set of actuators 196 of a third roller 198. First roller 190 is in rolling contact with second roller 194. Second roller 194 is in rolling contact with third roller 198. Third roller 198 is in rolling contact with a plate cylinder 200. A substrate 202 is located between third roller 198 and plate cylinder 200. Third roller 198 includes an image impression of an image (not shown), which is to be printed on substrate 202.

First roller 190 picks up ink from an ink tank 204 and transfers the ink to third roller 198, through second roller 194. Third roller 198 transfers the ink to substrate 202, thereby printing the image on substrate 202. First set of actuators 188, second set of actuators 192, third set of actuators 196, first roller 190, second roller 194, third roller 198, plate cylinder 200, substrate 202 and ink tank 204, together form a printing press 206. The printing press can include a plurality of rollers in addition to those illustrated in FIG. 3.

A rotation axis 208 of first roller 190 can move in directions designated by arrows 210 and 212. A rotation axis 214 of second roller 194 can move in directions 210 and 212. A rotation axis 216 of third roller 198 can move in directions 210 and 212. Each of rotation axes 208, 214, and 216 can move in directions 210 and 212, while one end thereof remains substantially stationary. Alternatively, each of rotation axes 208, 214 and 216 can move in directions 210 and 212, while both ends thereof move simultaneously by substantially the same amount. A rotation axis 218 of plate cylinder 200 is substantially stationary.

Camera 184 is located above substrate 202. When the contact pressure between first roller 190 and second roller 194, between second roller 194 and third roller 198, and between third roller 198 and plate cylinder 200 is minimal, third roller 198 prints one or more representative impressions 218 respective of the color of the ink in ink tank 204, in a setup pattern printing zone 220 of substrate 202. Setup pattern printing zone 220 is located at a predetermined location on substrate 202, for example at a margin thereof. Camera 184 detects the presence of representative impressions 218, in setup pattern printing zone 220, and processor 182 determines that representative impressions 218 are present at this setting of actuators 188, 192 and 196, according to an output of camera 184.

Processor 182 determines a no-print threshold $T_3$ respective of the adjacent pair of first roller 190 and second roller 194, similar to the manner processor 102 (FIG. 1), determines no-print threshold $T_1$ respective of the adjacent pair of first roller 110 and second roller 114, as described herein above. In a similar manner, processor 182 determines a no-print threshold $T_4$ respective of the adjacent pair of second roller 194 and third roller 198, and a no-print threshold $T_5$ respective of the adjacent pair of third roller 198 and plate cylinder 200.

Before determining no-print threshold $T_3$, processor 182 directs actuators 188 to set rotation axes 208 and 214 at a distance which ensures that representative impressions 218 are printed on substrate 202. Before determining no-print threshold $T_4$, processor 182 directs actuators 192 to set rotation axes 214 and 216 at a distance which ensures that representative impressions 218 are printed on substrate 202. Before determining no-print threshold $T_5$, processor 182 directs actuators 196 to set rotation axes 216 and 218 at a distance which ensures that representative impressions 218 are printed on substrate 202. Hence, before determining the no-print threshold for a selected pair of rollers, processor 182 directs the respective actuators to set all the other rollers to a distance, such that the probability that representative impressions 218 are printed on substrate 202 is equal to one.

In order to setup printing press 206, the user enters one or more printing parameters to processor 182. Processor 182 directs actuators 188, 192 and 196 to move rotation axes 208, 214 and 216, respectively, according to the printing parameters, relative to the no-print thresholds $T_3$, $T_4$, and $T_5$, respectively.

Figure 4A:
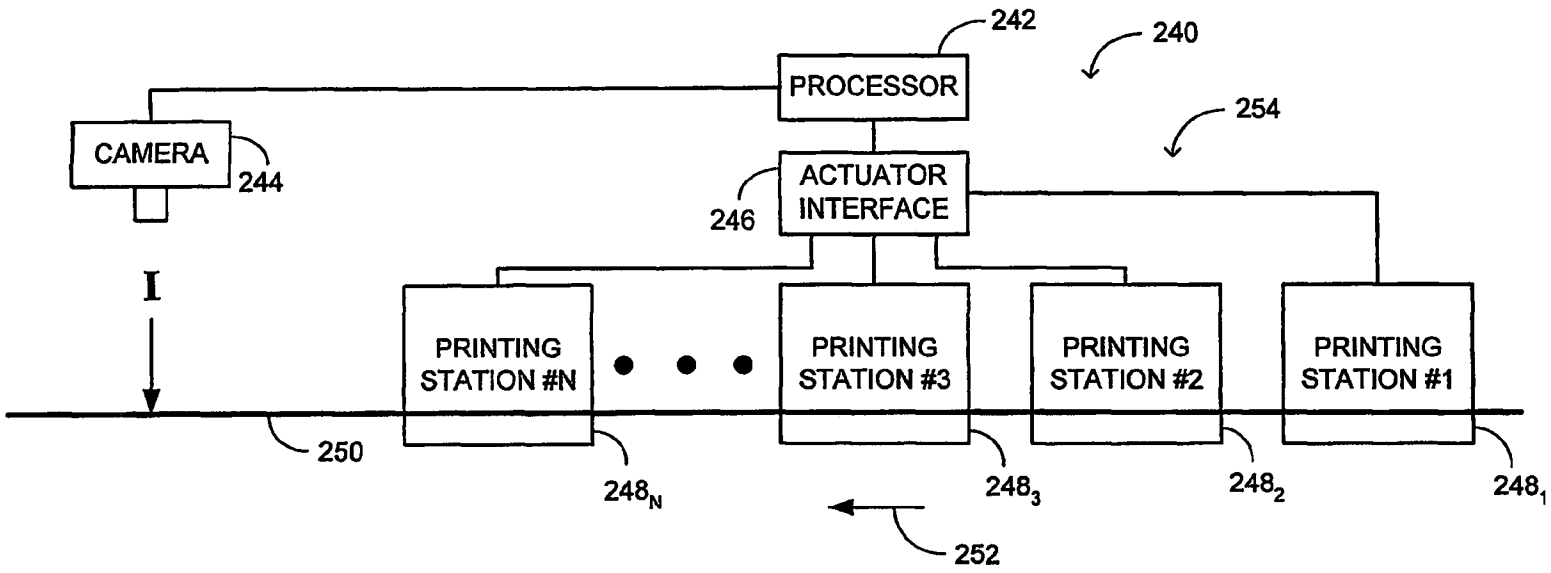
FIG. 4A is a schematic illustration of a system for setting up a printing press, constructed and operative in accordance with a further embodiment of the disclosed technique.
Figure 4B:
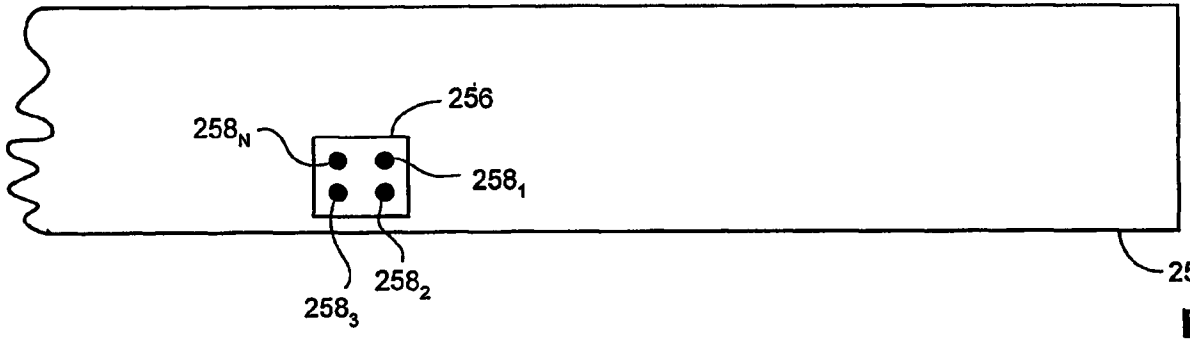
FIG. 4B is a schematic illustration of a top view of the substrate of the printing press of the system of FIG. 4A.

Reference is now made to FIGS. 4A and 4B. FIG. 4A is a schematic illustration of a system for setting up a printing press, generally referenced 240, constructed and operative in accordance with a further embodiment of the disclosed technique. FIG. 4B is a schematic illustration of a top view (view I) of the substrate of the printing press of the system of FIG. 4A.

System 240 includes a processor 242, a camera 244 and an actuator interface 246. Processor 242 is coupled with camera 244 and with actuator interface 246. Actuator interface 246 is coupled with respective actuators (not shown) of rollers (not shown) of a plurality of printing stations $\mathbf{248}_1$, $\mathbf{248}_2$, $\mathbf{248}_3$, and $\mathbf{248}_N$. Each of printing stations $\mathbf{248}_1$, $\mathbf{248}_2$, $\mathbf{248}_3$, and $\mathbf{248}_N$ is similar to printing station 206 (FIG. 3). Each of printing stations $\mathbf{248}_1$, $\mathbf{248}_2$, $\mathbf{248}_3$, and $\mathbf{248}_N$ can be of a different type, for example, flexographic, gravure, offset, and the like. A substrate 250 passes through a plurality of rollers of each of printing stations $\mathbf{248}_1$, $\mathbf{248}_2$, $\mathbf{248}_3$, and $\mathbf{248}_N$, in sequence, in a direction designated by an arrow 252. Printing stations $\mathbf{248}_1$, $\mathbf{248}_2$, $\mathbf{248}_3$, and $\mathbf{248}_N$ together with substrate 250 constitute a printing press 254.

Camera 244 observes a setup pattern printing zone 256 (FIG. 4B) on substrate 250. Setup printing pattern printing zone 256 is located at a predetermined location on substrate 250, for example at a margin thereof. Each of printing stations $\mathbf{248}_1$, $\mathbf{248}_2$, $\mathbf{248}_3$, and $\mathbf{248}_N$ prints a representative impression respective of the printing color thereof, within setup pattern printing zone 256. For example, printing station $\mathbf{248}_1$ prints a representative impression $\mathbf{258}_1$ in cyan, printing station $\mathbf{248}_2$ prints representative impression $\mathbf{258}_2$ in yellow, printing station $\mathbf{248}_3$ prints representative impression $\mathbf{258}_3$ in magenta, and printing station $\mathbf{248}_N$ prints representative impression $\mathbf{258}_1$ N in gold. In this case, camera 244 is a color camera, which identifies representative impressions $\mathbf{258}_1$, $\mathbf{258}_2$, $\mathbf{258}_3$, and $\mathbf{258}_1$ N, and determines the presence and absence thereof, according to the respective color thereof, irrespective of the shape thereof, or the location thereof within setup pattern printing zone 256.

Alternatively, each of printing stations $\mathbf{248}_1$, $\mathbf{248}_2$, $\mathbf{248}_3$, and $\mathbf{248}_N$ can print representative impressions $\mathbf{258}_1$, $\mathbf{258}_2$, $\mathbf{258}_3$, and $\mathbf{258}_N$, respectively, in the respective colors, but in different shapes. In this case, camera 244 can be a black and white gray level camera, which identifies each of representative impressions $\mathbf{258}_1$, $\mathbf{258}_2$, $\mathbf{258}_3$, and $\mathbf{258}_N$, and the presence and absence thereof, according to the respective shapes thereof. It is noted that in this case, it is not imperative for each of printing stations $248_1$, $248_2$, $248_3$, and $248_N$ to print representative impressions $258_1$, $258_2$, $258_3$, and $258_N$, respectively, at predetermined locations within setup pattern printing zone 256. It is further noted that if each of printing stations $248_1$, $248_2$, $248_3$, and $248_N$ prints representative impressions $258_1$, $258_2$, $258_3$, and $258_N$, respectively, in substantially the same color, a black and white gray level camera is still capable to identify representative impressions $258_1$, $258_2$, $258_3$, and $258_N$, respectively, and determine the presence and absence thereof, according to the respective shape alone, and irrespective of color or the predetermined locations.

Further alternatively, each of printing stations $248_1$, $248_2$, $248_3$, and $248_N$ can print representative impressions $258_1$, $258_2$, $258_3$, and $258_N$, respectively, at predetermined locations within setup pattern printing zone 256. Similarly, in this case, camera 244 can be a black and white gray level camera which can identify representative impressions $258_1$, $258_2$, $258_3$, and $258_N$, respectively, and determine the presence and absence thereof, according to the predetermined locations thereof, and irrespective of either the shape or the color thereof.

While observing setup pattern printing zone 256, camera 244 associates representative impressions $258_1$, $258_2$, $258_3$, and $258_N$, with printing stations $248_1$, $248_2$, $248_3$, and $248_N$, respectively, according to the respective characteristic of representative impressions $258_1$, $258_2$, $258_3$, and $258_N$ (e.g., color, shape, location). Camera 244 detects the presence of each of representative impressions $258_1$, $258_2$, $258_3$, and $258_N$ all at once, and produces a respective output. Processor 242 determines the no-print thresholds for each pair of adjacent rollers of each of printing stations $248_1$, $248_2$, $248_3$, and $248_N$, as described herein above in connection with FIG. 1.

In order to setup printing press 254, the user enters one or more printing parameters to processor 242. Processor 242 directs the respective actuators of the rollers of printing stations $248_1$, $248_2$, $248_3$, and $248_N$, to adjust the distance between each pair of adjacent rollers in each of printing stations $248_1$, $248_2$, $248_3$, and $248_N$, relative to the respective no-print thresholds, and according to the printing parameters. It is noted that due to the fact that camera 244 detects representative impressions $258_1$, $258_2$, $258_3$, and $258_N$, all at once, the setup process is considerably shorter, compared to the case where each printing station prints a respective representative impression, in a separate trial run, and the camera detects each representative impression in a separate trial run.

Figure 5:
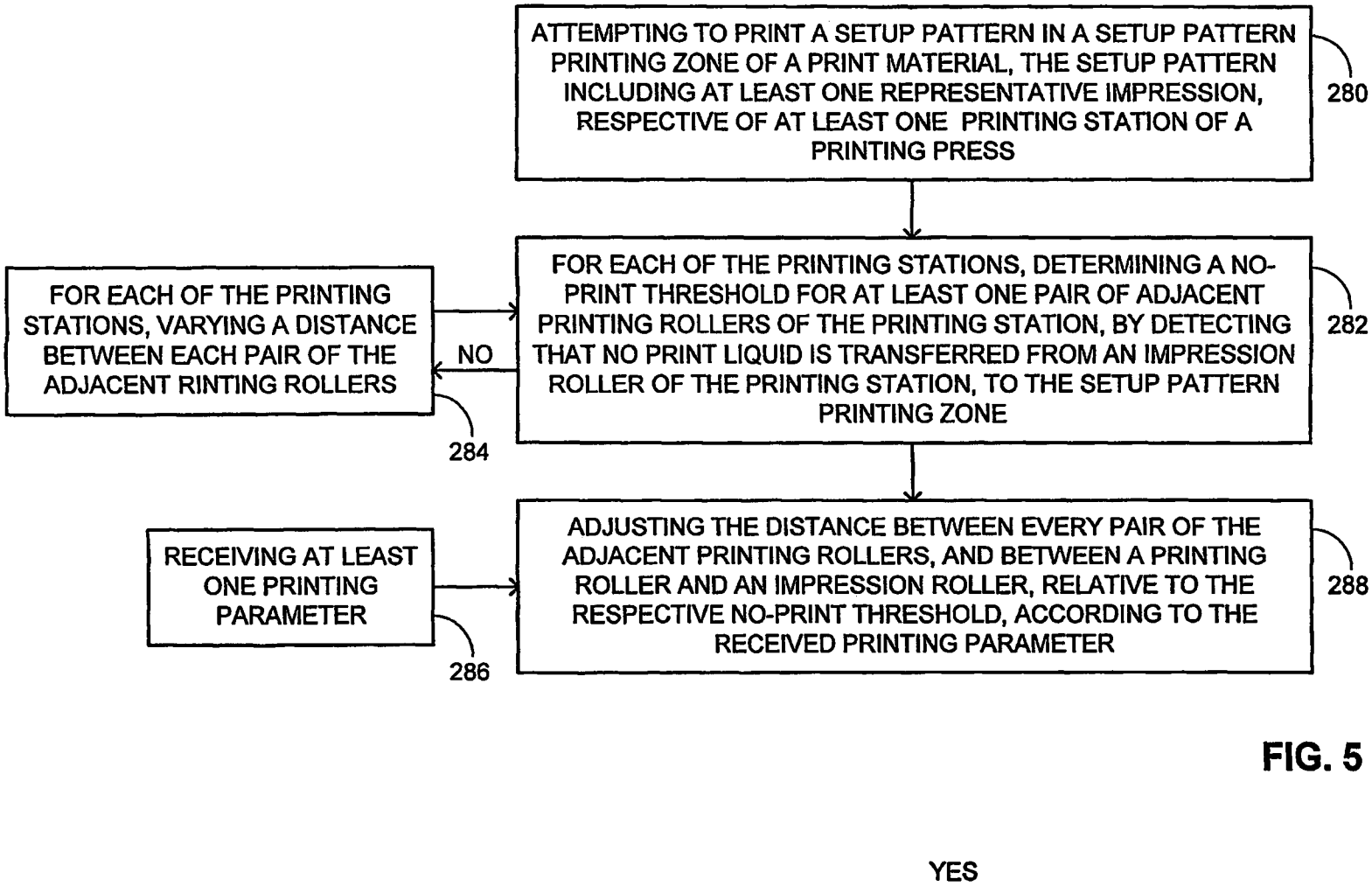
FIG. 5, is a schematic illustration of a method for operating the system of FIG. 4A, operative in accordance with another embodiment of the disclosed technique.

Reference is now made to FIG. 5, which is a schematic illustration of a method for operating the system of FIG. 4A, operative in accordance with another embodiment of the disclosed technique. In procedure 280, an attempt is made to print a setup pattern in a setup pattern printing zone of a print material, the setup pattern including at least one representative impression respective of at least one color.

With reference to FIG. 4A, printing press 254 attempts to print representative impressions $258_1$, $258_2$, $258_3$, and $258_N$, within setup pattern printing zone 256 of substrate 250. In case processor 102 (FIG. 1) initially directs actuators 108 to set the distance between rotation axes 122 and 128 to a distance equal to or greater than $d_{no\text{-}print}$ (FIG. 2), for example $d_{max}$, no representative impression is printed on substrate 118 in procedure 280. In case processor 102 initially directs actuators 108 to set the distance between rotation axes 122 and 128 to a distance less than $d_{no\text{-}print}$, representative impressions 132 are printed on substrate 118 in procedure 280.

In procedure 282, a no-print threshold is determined for each of the colors, by detecting when no print liquid is transferred from the impression roller to the setup pattern printing zone. With reference to FIGS. 1 and 2, processor 102 determines no-print threshold $T_1$, by directing actuators 108 to vary the distance between rotation axes 122 and 128 (procedure 284), until second roller 114 and impression roller 116 transfer no ink from ink tank 120 to substrate 118.

In procedure 286, at least one printing parameter is received. With reference to FIG. 1, processor 102 receives one or more printing parameters, respective of printing station 136, from a user, via the user interface.

In procedure 288, the distance between the pair of adjacent print liquid transferring rollers is adjusted, relative to the respective no-print threshold, according to the received printing parameter. With reference to FIGS. 1 and 2, processor 102 directs actuators 108 to adjust the distance between rotation axes 122 and 128 at a working distance $d_{work}$, relative to no-print threshold $T_1$, and according to the printing parameters, which processor 102 receives from the user.

It will be appreciated by persons skilled in the art that the disclosed technique is not limited to what has been particularly shown and described hereinabove. Rather the scope of the disclosed technique is defined only by the claims, which follow.

The invention claimed is:

1. A system for setting up a printing station, the printing station comprising at least one adjacent pair of printing rollers, said at least one adjacent pair of printing rollers including at least one ink transferring roller and an impression roller, the system comprising:

a camera for detecting the partial presence or absence of a representative impression printed on a print material, said representative impression being printed on said print material by transferring a print liquid from an ink tank to said print material, through said printing rollers;

an actuator interface, coupled with at least one actuator, for directing said at least one actuator to move at least one printing roller of said printing station, to change the distance between rotation axes of said at least one adjacent pair of said printing rollers; and a processor coupled with said camera and with said actuator interface, for at least one of said adjacent pair of said printing rollers, said processor receiving an output from said camera, said processor determining a no-print threshold distance according to said output from said camera said no-print threshold distance being a minimal distance between said rotation axes of said at least one adjacent pair of said printing rollers, at which no print liquid is transferred to said print material, which is a minimum distance increment which the actuator can controllably adjust from a maximum distance between said rotation axes of said adjacent pair of printing rollers at which a partial presence of said representative impression is generated, said processor directing said actuator via said actuator interface to set the distance between said at least one adjacent pair of said printing rollers to a respective working distance, the respective working distance being at a predetermined displacement from said no-print threshold.

2. The system according to claim 1, wherein said processor determines said respective working distance relative to said respective no-print threshold distance according to at least one printing parameter respective of said printing station.

3. The system according to claim 2, wherein said at least one printing parameter is selected from the list consisting of:

material of an outer surface of said at least one printing roller;

thickness of said material;

roughness of said material;

hardness of said material;

physical properties of said print liquid;
type of said print material;
speed of travel of said print material;
ambient temperature; and
ambient humidity.

4. The system according to claim 2, wherein said processor directs said at least one actuator via said actuator interface, to move a respective one of said printing rollers, according to said respective working distance.

5. The system according to claim 1, further comprising a user interface coupled with said processor, said user interface receiving data respective of at least one printing parameter of said printing station.

6. The system according to claim 1, wherein said camera is a black and white gray level camera.

7. The system according to claim 1, wherein said camera is a color camera.

8. The system according to claim 1, wherein said camera comprises a spectrophotometer.

9. The system according to claim 1, wherein said printing station is selected from the list consisting of:
flexographic;
gravure; and
offset.

10. The system according to claim 1, wherein said at least one actuator moves both ends of a respective one of said printing rollers, by substantially the same amount.

11. The system according to claim 1, wherein said at least one actuator moves the two ends of a respective one of said printing rollers, by different amounts.

12. The system according to claim 1, wherein said print liquid is selected from the list consisting of: ink; adhesive; and lacquer.

13. A system for setting up a printing press, the printing press including at least one printing station, the at least one printing station comprising at least one adjacent pair of printing rollers, said at least one adjacent pair of printing rollers including at least one ink transferring roller and an impression roller, the system comprising:

at least one camera for detecting the presence or absence of at least one representative impression on said print material, said at least one representative impression being respective of a respective one of said at least one printing station, said at least one respective representative impression being printed on said print material by transferring a print liquid from at least one ink tank to said print material, through said printing rollers;

an actuator interface, coupled with at least one actuator, for directing said at least one actuator to move at least one printing roller of said printing station, to change the distance between rotation axes of said at least one adjacent pair of said printing rollers; and a processor coupled with said at least one camera and with said actuator interface, for at least one of said adjacent pair of said printing rollers, said processor receiving an output from said at least one camera, said processor determining a no-print threshold distance respective of said at least one printing station according to said output from said camera, said respective no-print threshold being a minimal distance between said rotation axes of said at least one adjacent pair of said printing rollers at which no print liquid is transferred to said print material, which is a minimum distance increment which the actuator can controllably adjust from a maximum distance between said adjacent pair of printing rollers at which a partial presence of said representative impression is generated, said processor directing said actuator via said actuator interface to set the distance between said at least one adjacent pair of said printing rollers to a working distance, the working distance being at a predetermined displacement from said no-print threshold.

14. The system according to claim 13, wherein each of said at least one representative impression has a different characteristic.

15. The system according to claim 13, wherein each of said at least one representative impression is in a different color.

16. The system according to claim 13, wherein each of said at least one representative impression is associated with a predetermined location within said setup pattern printing zone.

17. Method for setting up a printing press, the printing press including at least one printing station, the printing station comprising at least one adjacent pair of printing rollers, said at least one adjacent pair of printing rollers including at least one ink transferring roller and an impression roller; the method comprising the procedures of:

predetermining a respective working distance displacement from a respective no-print threshold distance for at least one adjacent pair of said printing rollers;

attempting to print a setup pattern in a setup pattern printing zone of a print material of said printing press, said setup pattern printing zone including at least one representative impression, each of said at least one representative impression being associated with a respective one of said at least one printing station;

for each of said at least one printing station, determining a no-print threshold distance respective of said at least one pair of adjacent printing rollers, by varying the distance between the rotation axes of said at least one pair of adjacent printing rollers, and by detecting total absence and partial presence of said representative impression, said no-print threshold distance being a minimal distance between said rotation axes, at which no print liquid is transferred to said print material, which is a minimum distance increment which can be controllably adjusted from a maximum distance between said rotation axes of said adjacent pair of printing rollers at which a partial presence of said representative impression is generated; and setting the distance between said at least one adjacent pair of said printing rollers to said respective working distance.

18. The method according to claim 17, wherein said respective working distance relative to said respective no-print threshold distance is determined according to at least one printing parameter respective of said at least one printing station.

19. The method according to claim 18, wherein said working distance is defined as the distance between said rotation axes at which said printing station prints a respective printing job.

20. The method according to claim 19, wherein said working distance respective of said respective printing job, is invariant relative to said no-print threshold.

21. The method according to claim 18, further comprising a procedure of adjusting said distance between said rotation axes, according to said respective working distance.

22. The method according to claim 18, further comprising a procedure of receiving data respective of said at least one printing parameter.

23. The method according to claim 17, wherein said procedure of determining said no-print threshold is performed according to a binary search.

24. The method according to claim 17, wherein said procedure of determining said no-print threshold for each of said at least one adjacent pair of printing rollers respective of each of said at least one printing station, comprises the sub-procedures of:

selecting one of said at least one adjacent pair of printing rollers;

for each printing station, setting said distance between every one of said at least one pair of adjacent printing rollers, other than said selected pair of adjacent printing rollers, to a value ensuring full contact between said every one of said at least one pair of adjacent printing rollers other than said selected pair of adjacent printing rollers; and varying said distance between said selected pair of adjacent printing rollers, until said no-print threshold for said selected pair of adjacent printing rollers is determined.

25. The method according to claim 17, wherein each of said at least one representative impression is in a different color.

26. The method according to claim 17, wherein each of said at least one representative impression is associated with a predetermined location within said setup pattern printing zone.

* * * * *